US005536663A

United States Patent [19]

Mueller-Kirschbaum et al.

[11] Patent Number: 5,536,663

[45] Date of Patent: Jul. 16, 1996

[54] WASHING PROCESS FOR INSTITUTIONAL LAUNDRIES

[75] Inventors: Thomas Mueller-Kirschbaum, Solingen; Edgar Koeppelmann, Hilden, both of United Kingdom

[73] Assignee: Henkel Kommanditgesellschaft auf Aktien, Duesseldorf, Germany

[21] Appl. No.: 290,865

[22] PCT Filed: Feb. 9, 1993

[86] PCT No.: PCT/EP93/00303

§ 371 Date: Aug. 18, 1994

§ 102(e) Date: Aug. 18, 1994

[87] PCT Pub. No.: WO93/16225

PCT Pub. Date: Aug. 19, 1993

[30] Foreign Application Priority Data

Feb. 18, 1992 [DE] Germany ..... 42 04 806.0

[51] Int. Cl.[6] ..... G01N 21/64; D06F 39/02

[52] U.S. Cl. ..... 436/55; 436/172; 134/18; 134/36

[58] Field of Search ..... 436/55, 56, 120, 436/140, 172; 134/56 R, 65, 113, 18, 36; 356/72, 73; 250/362, 459.1

[56] References Cited

U.S. PATENT DOCUMENTS

| | | | |
|---|---|---|---|
| 3,669,891 | 6/1972 | Greenwood et al. | 252/90 |
| 4,733,798 | 3/1988 | Brady et al. | 222/23 |
| 4,783,314 | 11/1988 | Hoots et al. | 422/3 |
| 4,992,380 | 2/1991 | Moriarty et al. | 436/55 |
| 5,370,743 | 12/1994 | Usui et al. | 134/18 |

FOREIGN PATENT DOCUMENTS

| | | |
|---|---|---|
| 0205671 | 12/1986 | European Pat. Off. . |
| 2949254 | 6/1981 | Germany . |

*Primary Examiner*—Jeffrey R. Snay

*Attorney, Agent, or Firm*—Ernest G. Szoke; Wayne C. Jaeschke; Real J. Grandmaison

[57] ABSTRACT

A process for monitoring the concentration level of a detergent or bleach in a washing liquor of an institutional laundry machine by measuring emitted fluorescence radiation in the washing liquor.

7 Claims, 3 Drawing Sheets

WASHING PROCESS FOR INSTITUTIONAL LAUNDRIES

BACKGROUND OF THE INVENTION

1. Field of the Invention

This invention relates to a washing process for institutional laundries in which different detergents are introduced into the liquor in the same wash cycle, but at different stages of the washing process.

2. Discussion of Related Art

In institutional laundries, different detergents are often introduced into the liquor in the same wash cycle, but at different stages of the washing process, for example first a detergent containing anionic surfactants and later a detergent containing nonionic surfactants. In recent years, washing processes have been continually improved both from the ecological and from the economic point of view. Reductions have been achieved in the use of energy, detergent, water and time. Significant improvements in this regard were obtained in particular by introduction of the countercurrent washing principle and fully continuous or cycle-dependent batch washing machines. However, further savings of detergent, water, particularly rinsing water, energy and time have been prevented by the absence of reliable, continuous and automatic processes for determining the concentration of detergents and bleaches in the liquor. The measuring signal of such processes could be used to control metering, to terminate individual process steps, etc., so that a satisfactory washing result could be obtained with the minimum use of energy, detergent, water and time. A determination process of the type in question would enable optimal time-related concentration profiles of detergents and bleaches to be maintained in batch washing machines. Optimization of the rinse cycle with a minimum quantity of water in a short time would also be possible without an excessive proportion of the wash liquor remaining behind in the washed fabrics.

Although processes for determining the concentration of detergents and bleaches are known, they are attended by a number of disadvantages which have prevented them from being used on a wide scale in practice. They are generally based on the measurement of physicochemical parameters, for example conductivity and pH value. However, conductivity and pH measurements can be affected by the widely fluctuating introduction of electrolytes and acids or bases with the soiled washing.

It is also known that the concentration of chemical substances in a liquid can be determined by flow injection analysis. In this process, a reagent is added to the liquor in a diluted or undiluted sidestream and the concentration is photometrically determined.

Where flow injection analysis is used to determine the concentration of detergents or bleaches in the wash liquor, other substances which must be ecologically and toxicologically safe often have to be added to the detergent. However, in order to determine the concentration with sufficient accuracy, relatively large quantities of these substances often have to be added. Additional effort is involved in the addition of the reagent to initiate the color reaction. The measuring solutions have to be separately disposed of. The general need for a reduction in the level of manual intervention in the washing process conflicts with the need to replace the spent reagents. Other problems are caused by the cloudiness and suspended particles present in the solution to be measured. In order to avoid interference with the extinction measurement, the particles in question have to be removed beforehand, for example by filtration. Since flow injection analysis cannot take place in the wash liquid itself, an often considerable delay between sampling and measurement has to be accepted.

DE 29 49 254 A1 describes a washing process in which the concentration of a detergent is determined from its fluorescence radiation. However, where several detergents are used in the same wash liquor, their concentrations cannot be individually determined.

Accordingly, the problem addressed by the present invention was to provide a process of the type mentioned at the beginning which would not have any of the disadvantages mentioned above.

DESCRIPTION OF THE INVENTION

According to the invention, the solution to this problem is characterized in that detergents or bleaches which emit fluorescence radiation in different wavelength ranges on exposure to light are used, in that light is transported by optical fibers to measuring points in the wash liquor, the light emitted there is collected and is delivered by the same optical fiber or by a second optical fiber to a receiving and evaluation unit which detects the intensities of the fluorescence radiation in one or more of the different wavelength ranges and determines the concentration of the detergents or bleaches in the wash liquor via a calibration effected with the detergents or bleaches used.

In one advantageous embodiment, the measurement is carried out in the liquor itself. The distance between the point of measurement and the light source and also the receiving and evaluation unit may assume a new value and still does not lead to any time delay. The process may be used for all wash liquors because the optical fibers are also unaffected by chemically aggressive liquids. The use of the process according to the invention is also not limited in regard to pressure and temperature. Existing lines may be modified without significant expense because all that is required are the openings for the optical fibers to pass through. In addition, the process according to the invention is maintenance-free. In general, no other substances need be added to the detergent or bleach. No reagents have to be added for the concentration measurements and there are no measuring solutions to be disposed of. Another advantage is that there is no need for interim calibrations.

The detergent or bleach is preferably exposed to ultraviolet light of visible light. Accordingly, the concentration measurement involves fluorescent ingredients of the detergent or bleach.

The concentration of the detergent may advantageously be determined from the fluorescence radiation emitted by the optical brighteners present in the detergent. On the other hand, however, the concentration may be determined from the fluorescence radiation of alkyl benzenesulfonate present in the detergent.

The process according to the invention is also used with advantage in batch washing machines. These washing machines operate fully continuously or are cycle-dependent. The soiled washing is delivered on conveyor belts or suspended tracks. As it travels through the machines, the washing passes through the individual washing zones, such as wetting, prewashing, clear washing and rinsing, the countercurrent washing principle being applied. Under this principle, the washing process is carried out in a continuously flowing stream which runs in the opposite direction to the washing. In order to minimize outlay on equipment where the process according to the invention is used to determine concentration at several measuring points, it is proposed that the optical fibers associated with the measuring points be connected to a single light source and a single receiving and evaluation unit by a reversing switch.

The process according to the invention affords particular advantages in regard to the introduction and regeneration of the detergent or bleach in the wash liquor. The introduction of the detergent or bleach is preferably controlled by a control system which compares the actual concentration determined with a pre-set concentration.

The invention also enables the rinsing time to be shortened and the amount of rinsing water required to be reduced. In another embodiment of the invention, therefore, rinsing is terminated when the actual concentration determined has fallen below a pre-set concentration.

BRIEF DESCRIPTION OF THE DRAWINGS

Embodiments of the invention are described by way of example in the following with reference to the accompanying drawings, wherein.

Figure 1A:
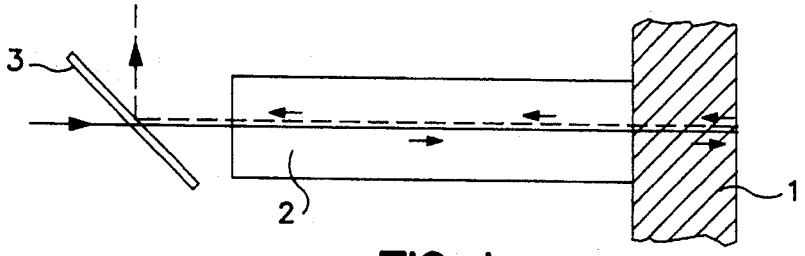
FIG. 1 shows various sensor systems with which the process according to the invention may be carried out.
Figure 1B:
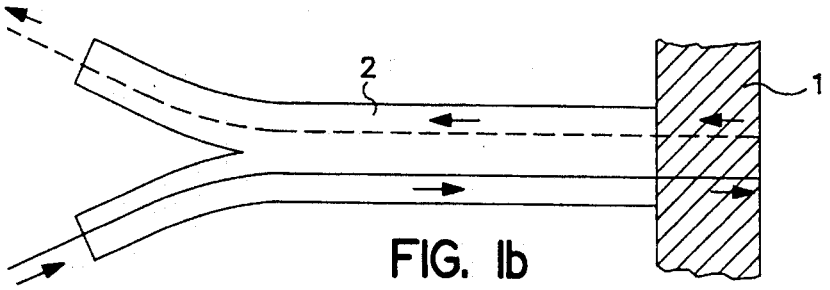
Figure 1C:
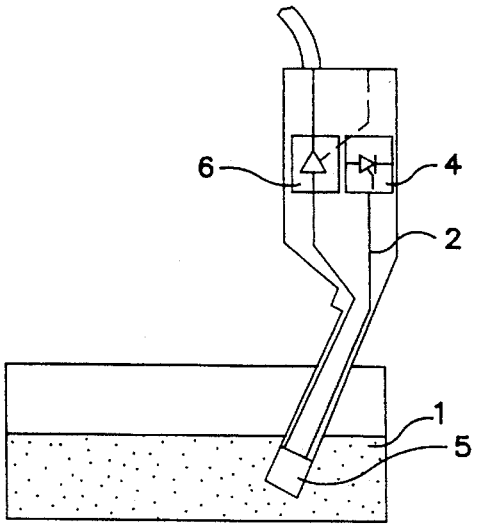
Figure 1D:
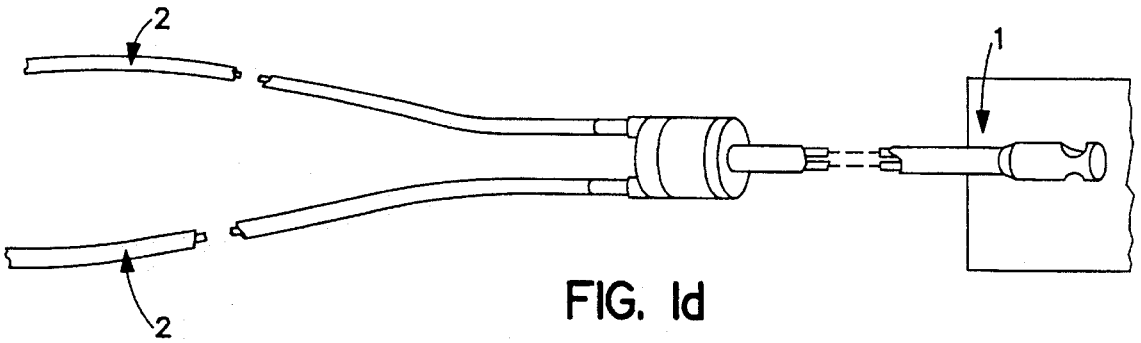

Fluorescent ingredients already present in the detergent or bleach may be used for the fluorescence measurement. However, other fluorescent markers, which are additionally added, may also be used. Similarly, where concentration is measured by determining the change in the state of polarization, substances which bring about such a change, for example sugar, may be added to the detergent or bleach.

DETAILED DESCRIPTION OF THE INVENTION

The sensor arrangements schematically illustrated by way of example in FIG. 1 may be used to measure fluorescence. Referring to FIG. 1*a*, the light passing from the light source into the measuring solution 1 and the emitted light can be guided through the same optical fiber 2 providing a semitransparent mirror 3 is arranged between the light source and the receiving unit. However, the transmitted light and the emitted light may also be guided through different optical fibers (FIG. 1*b*). In the arrangement shown in FIG. 1*c*, the light emitted from the light source 4 and transmitted into the measuring solution 1 through the optical fiber 2 impinges on a reflector 5 and is detected by the receiving unit 6 via another optical fiber. Separate light emission and transmission paths are also shown in FIG. 1*d*.

Figure 2:
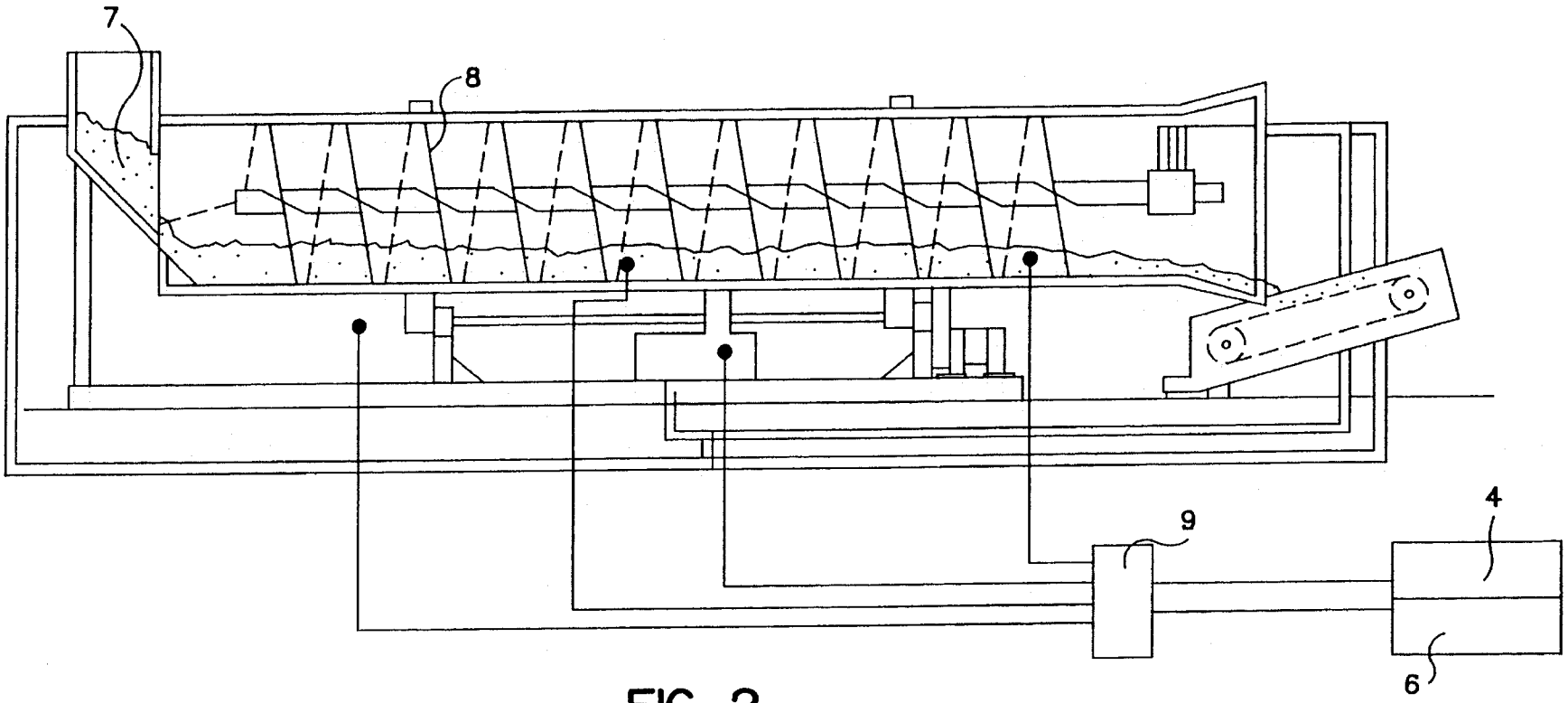
FIG. 2 illustrates a batch washing machine with several measuring points for the measurement of concentration.

FIG. 2 shows the Voss-Archimedia batch washing machine with a concentration measuring system connected thereto. The washing 7 is continuously transported from left to right by a screw 8. At the same time, a continuously flowing liquor stream runs in the opposite direction to the washing. The concentration of the detergent in the liquor is measured at four measuring points. A reversing switch a connects the optical fibers extending to and from the measuring points to the light source 4 and to the receiving unit 6, so that one light source and detector unit is sufficient even for several measuring points.

Figure 3:
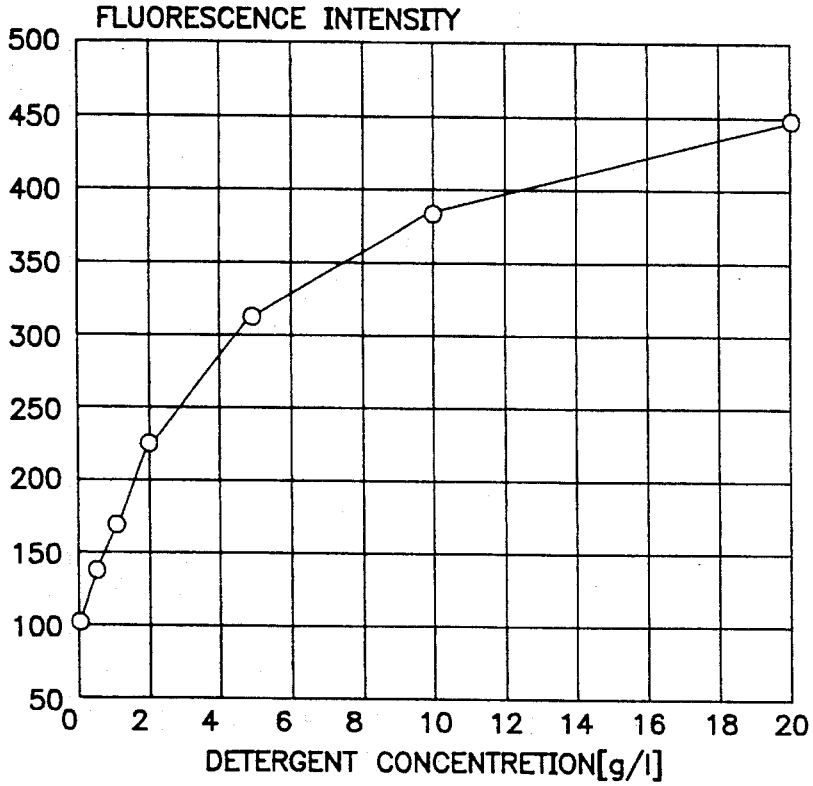
FIG. 3 shows the dependence of the fluorescence intensity on the concentration of detergent.

In FIG. 3, the fluorescence intensity is plotted in arbitrary units against the detergent concentration in g/1 in aqueous solution. The detergent contains approximately 0.1% by weight of an optical brightener which fluoresces in the wavelength range from 400 to 700 nm on exposure to UV light with a wavelength of 366 nm.

It can clearly be seen from the graph that the concentration of detergent in the liquor can be gauged very accurately from the measured fluorescence intensity.

Figure 4:
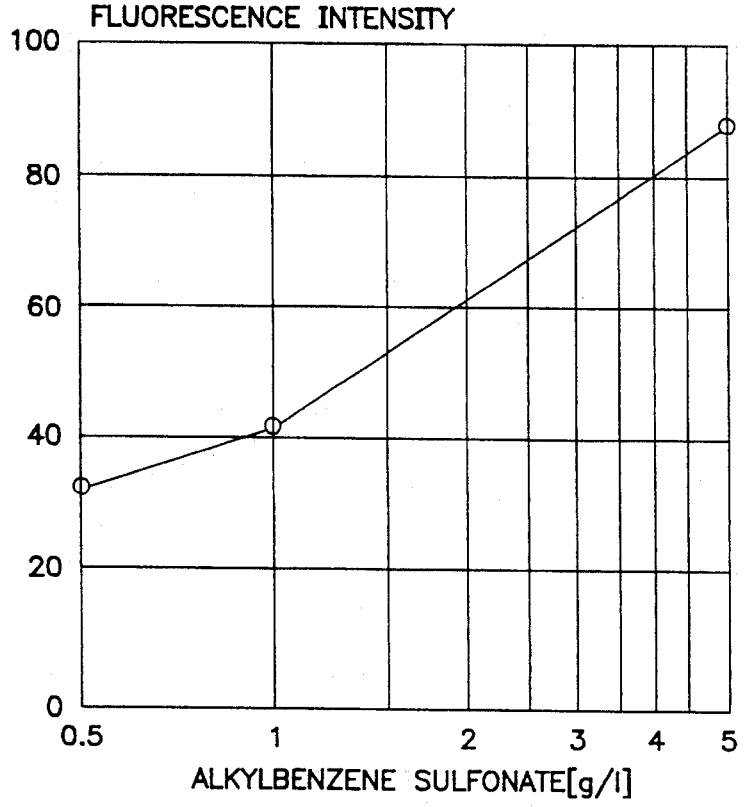
FIG. 4 shows the dependence of the fluorescence intensity on the concentration of an alkyl benzenesulfonate solution.

A corresponding dependence of the fluorescence intensity of an aqueous alkyl benzenesulfonate solution is shown in FIG. 4. The aqueous solution was exposed to UV light with a wavelength of 366 nm and emitted light in the wavelength range from 400 to 700 nm. In this case, too, the direct dependence of the fluorescence intensity on the concentration can clearly be seen.

LIST OF REFERENCE NUMERALS

1 Measuring solution
2 Optical fibers
3 Semitransparent mirror
4 Light source
5 Reflector
6 Receiving unit
7 Washing
8 Screw
9 Reversing switch

We claim:

1. A process for monitoring the concentration of different detergents or bleaches in a washing liquor comprising introducing said detergents or bleaches into the same washing cycle but at different stages, wherein said detergents or bleaches emit fluorescence radiation at different wavelength ranges on exposure to light, transporting light by optical fibers to measuring points in said washing liquor, collecting the intensities of the fluorescence radiation emitted from said detergents or bleaches, and delivering said intensities by said optical fibers or by a different optical fiber to a receiving and evaluation unit which measures the intensities of the fluorescence radiation at one or more of said different wavelength ranges and determines the concentration of said detergents or bleaches in said washing liquor via a pre-set calibration of said detergents or bleaches.

2. The process as in claim 1 wherein the concentration of a detergent is determined from the fluorescence radiation which is emitted from optical brighteners present in the detergent.

3. The process as in claim 1 wherein the concentration of a detergent is determined from the fluorescence radiation which is emitted by alkyl benzene sulfonate present in the detergent.

4. The process as in claim 1 wherein the process is used in continuous or cycle-dependent batch washing machines, the concentration of a detergent or bleach is measured at several measuring points, and the optical fibers associated with the measuring points are connected by a reversing switch to a single light source and a single receiving and evaluation unit.

5. The process as in claim 1 wherein a detergent or bleach is introduced into said washing liquor, the introduction of said detergent or bleach being controlled by a control system which compares with the actual concentration determined with a pre-set concentration.

6. The process as in claim 1 wherein a rinsing step is terminated when the actual detergent or bleach concentration determined has fallen below a pre-set concentration.

7. The process as in claim 1 wherein said washing liquor contains optical brighteners which emit fluorescence radiation in a wavelength range from 400 to 700 nm.

* * * * *